US010195624B2

(12) United States Patent
Bertrand et al.

(10) Patent No.: US 10,195,624 B2
(45) Date of Patent: Feb. 5, 2019

(54) ASSEMBLY FOR DISPENSING FLUID PRODUCT

(71) Applicant: APTAR RADOLFZELL GMBH, Radolfzell (DE)

(72) Inventors: Eric Bertrand, Jouy en Josas (FR); Fabrice Perignon, Verneuil (DE); Thomas Reichle, Muhlhausen-Ehingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 14/890,463

(22) PCT Filed: May 13, 2014

(86) PCT No.: PCT/EP2014/059731
§ 371 (c)(1),
(2) Date: Nov. 11, 2015

(87) PCT Pub. No.: WO2014/184177
PCT Pub. Date: Nov. 20, 2014

(65) Prior Publication Data

US 2016/0121349 A1 May 5, 2016

(30) Foreign Application Priority Data

May 13, 2013 (FR) ..... 13 54265

(51) Int. Cl.
*B05B 11/00* (2006.01)
*B65D 83/56* (2006.01)

(52) U.S. Cl.
CPC ..... *B05B 11/0027* (2013.01); *B05B 11/0038* (2018.08); *B05B 11/3042* (2013.01); *B65D 83/56* (2013.01)

(58) Field of Classification Search
CPC ..... B05B 11/0027; B05B 11/3042; B05B 11/0037; B65D 83/56; B65D 83/40; A61M 15/08; A05B 11/3056
(Continued)

(56) References Cited

U.S. PATENT DOCUMENTS 5,474,212 A * 12/1995 Ichikawa ..... B05B 11/0043 222/105
6,053,363 A * 4/2000 Revenu ..... B05B 11/0054 222/183
(Continued)

FOREIGN PATENT DOCUMENTS

DE 197 53 147 A1 6/1999
WO 02/053295 A1 7/2002
(Continued)

OTHER PUBLICATIONS

International Search Report for PCT/EP2014/059731 dated Jul. 23, 2014.
(Continued)

*Primary Examiner* — Nicholas J Weiss
*Assistant Examiner* — Robert Nichols, II
(74) *Attorney, Agent, or Firm* — Sughrue Mion, PLLC

(57) ABSTRACT

A fluid dispenser assembly including a fluid dispenser having a reservoir forming a bottom wall. The dispenser assembly further includes a casing that surrounds the fluid dispenser at least in part, and that defines an insertion and extraction opening through which the fluid dispenser is insertable by sliding. The casing includes a blocker mechanism for blocking the dispenser in the casing, and an unblocker mechanism for de-activating the blocker mechanism so as to be able to extract the fluid dispenser from the casing by sliding.

19 Claims, 4 Drawing Sheets

Figures 3A, 3B:
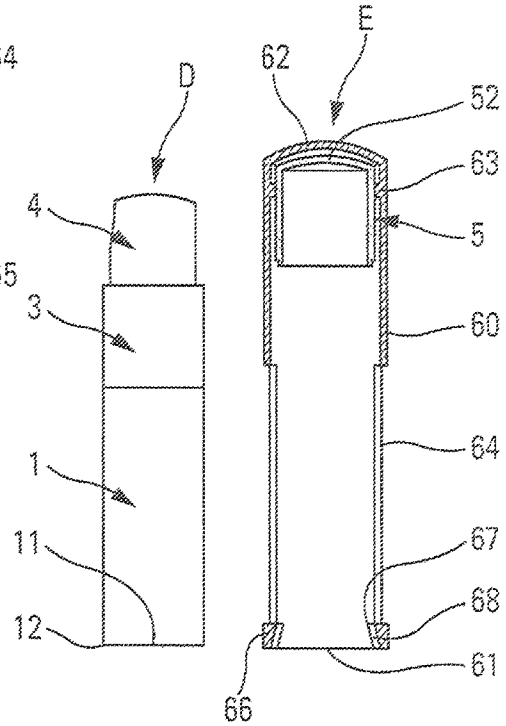

(58) Field of Classification Search
USPC ..... 222/179.5, 153.09, 182, 183
See application file for complete search history.

(56) References Cited

U.S. PATENT DOCUMENTS

| | | | | |
|---|---|---|---|---|
| 6,364,166 | B1 | 4/2002 | Ritsche et al. | |
| 8,347,879 | B2 * | 1/2013 | Davies | A61M 15/08 128/200.14 |
| 2006/0102660 | A1 * | 5/2006 | Bichot | A45D 34/02 222/321.9 |

FOREIGN PATENT DOCUMENTS

| | | | |
|---|---|---|---|
| WO | 2007/062205 | A2 | 5/2007 |
| WO | 2013/009445 | A1 | 1/2013 |

OTHER PUBLICATIONS

International Preliminary Report on Patentability, issued by the International Bureau in International Application No. PCT/EP2014/059731.

* cited by examiner

ASSEMBLY FOR DISPENSING FLUID PRODUCT

CROSS REFERENCE TO RELATED APPLICATIONS

This application is a National Stage of International Application No. PCT/EP2014/059731 filed May 13, 2014, claiming priority based on French Patent Application No. 13 54265 filed May 13, 2013, the contents of all of which are incorporated herein by reference in their entirety.

The present invention relates to a fluid dispenser assembly comprising a fluid dispenser having a reservoir forming a neck and a bottom wall, a dispenser member, such as a pump, and a pusher. Advantageous fields of application for the present invention are the fields of perfumery and of cosmetics, without forgetting the field of pharmacy.

It is entirely conventional to fit a fluid dispenser with a protective cap that comes to cover the pusher in order to protect it and prevent unintentional or accidental actuation. In general, the protective cap is mounted in removable manner on a stationary element of the dispenser, e.g. a fastener ring or a covering hoop. The protective cap may be held merely by friction, or by snap-fastening. When the user wishes to use the fluid dispenser, initially the user removes the protective cap so as to uncover the pusher, then the user presses the pusher so as to dispense a dose of fluid that has been extracted from the reservoir by the pump. This design is entirely conventional for a fluid dispenser in the fields of cosmetics and perfumery.

An object of the present invention is to propose an alternative or an addition to the conventional protective cap. An object of the present invention is to increase the protection of the fluid dispenser, and more particularly to extend it to component elements other than the pusher. Another object of the present invention is to make the fluid dispenser difficult to use, very particularly for children.

To do this the present invention proposes a fluid dispenser assembly comprising a fluid dispenser having a reservoir forming a neck and a bottom wall, a dispenser member, such as a pump, and a pusher; the dispenser assembly being characterized in that it further comprises a casing that surrounds the fluid dispenser at least in part, and that defines an insertion and extraction opening through which the fluid dispenser is insertable by sliding, the casing including blocker means for blocking the dispenser in the casing, and unblocker means for de-activating the blocker means so as to be able to extract the fluid dispenser from the casing by sliding. Thus, the casing is not a simple casing into which the dispenser can be inserted freely and from which it can be extracted freely, but rather it is a genuine protective casing into which it is easy to insert the dispenser, while extracting it is made more complicated by the presence of blocker means, which can be de-activated only by acting on the unblocker means. This requires the user to have a degree of dexterity and thinking skills beyond the reach of most children.

In a first advantageous embodiment, the casing forms a protective cap for the pusher. In this configuration, the casing replaces the protective cap. In a preferred variant, the casing includes holder means for holding a protective cap for the pusher inside the casing. In this configuration, the protective cap is secured to the casing while inserting the dispenser inside the casing. During subsequent extraction, the protective cap remains blocked in the casing, so that the dispenser can be used directly by pressing on the pusher.

According to an advantageous characteristic of the invention, the blocker means comprise blocking edges that are sharp and suitable for coming into engagement with the reservoir, advantageously with its bottom wall. In this way, when the user inserts the dispenser fully into the casing, the blocking sharp edges come into engagement with the bottom wall of the reservoir so as to hold the dispenser inside the casing.

According to another advantageous characteristic, the blocker means are formed at a collar that is elastically deformable and that acts as unblocker means. Preferably, the blocker means are arranged in diametrally-opposite manner, such that elastically deforming the collar causes the blocker means to move away from each other, so as to release the dispenser. When the collar has a shape that is circular at rest, elastically deforming the collar causes it to become oval, such that the opposite sides, where deformation pressure is exerted move towards each other, while the other opposite sides where the blocker means are situated move apart. Naturally, the collar may present a shape other than circular.

According to still another very advantageous characteristic of the invention, the casing may further include at least one grip slot, advantageously two opposite grip slots through which the dispenser may be gripped by means of one or two digits, so as to slide it in the casing when the blocker means are de-activated. Advantageously, the grip slot(s) is/are arranged above an elastically-deformable collar. Advantageously, the collar forms the blocker means that are arranged in diametrally-opposite manner below respective grip slots. Preferably, the blocker means are separated by the unblocker means in the form of unblocking sections of the collar, on which sections pressure is exerted to deform the collar elastically and thus to move the blocker means away from each other, so as to be able to slide the dispenser out from the casing by gripping it through the grip slot(s). Extracting the dispenser from the casing thus requires two different hand actions to be coordinated simultaneously, namely applying pressure on the unblocker means, and gripping the reservoir of the dispenser through the slots so as to slide it out from the casing. In general, the thumb and the index finger of each hand are used, namely one hand for exerting pressure on the collar, and the other hand for gripping the reservoir of the dispenser. Combining these two operations is relatively difficult, and generally beyond the reach of children.

The spirit of the invention resides in replacing or adding to a conventional protective cap, so as to impart thereto a function of safety in use, in addition to increasing protection. Simultaneously combining two different hand actions so as to extract the casing makes it possible to obtain a high level of safety in use.

The invention is described more fully below with reference to the accompanying drawings, which show an embodiment of the invention by way of non-limiting example.

Figure 2B:
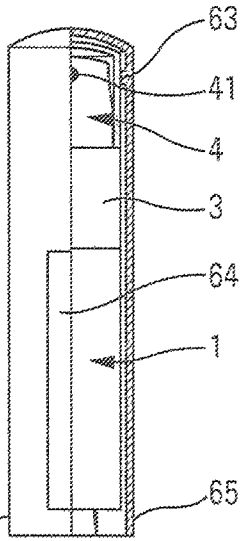
Figure 2A:
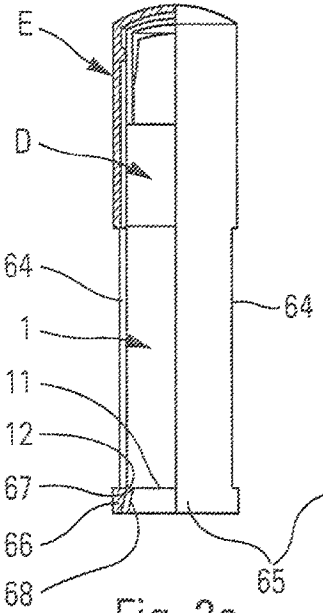
Figure 1B:
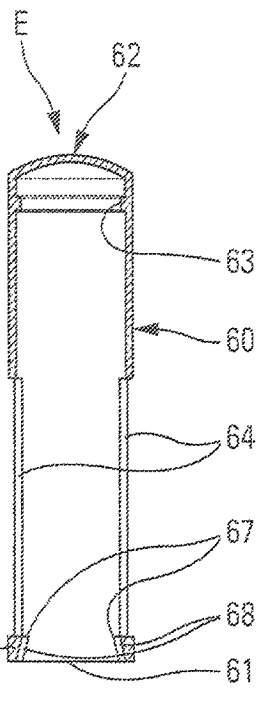
Figure 1A:
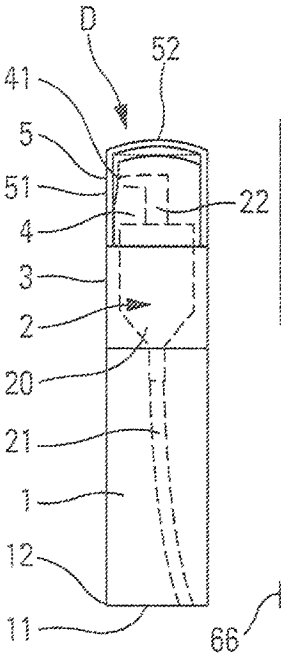
Figure 4A:
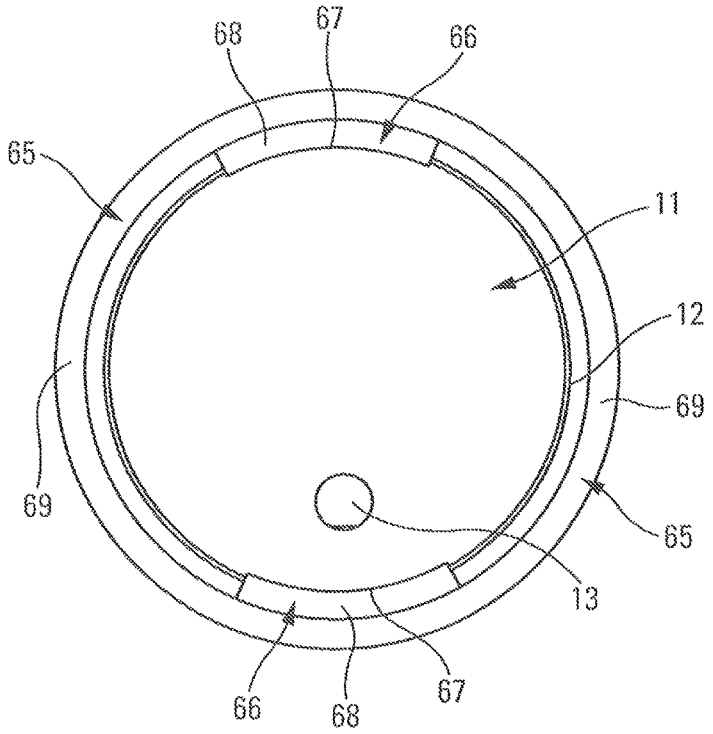
Figure 4B:
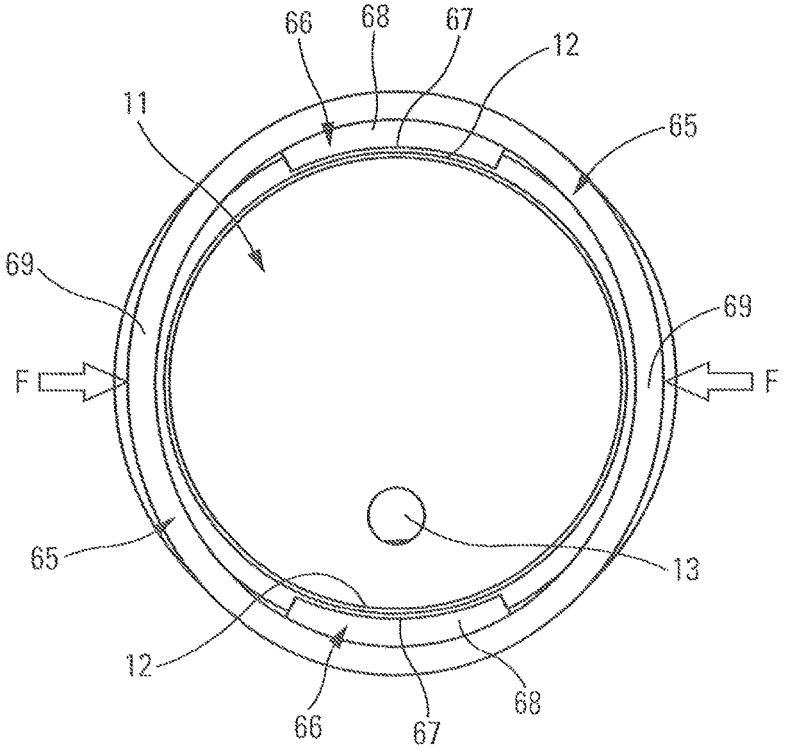
Figure 5A:
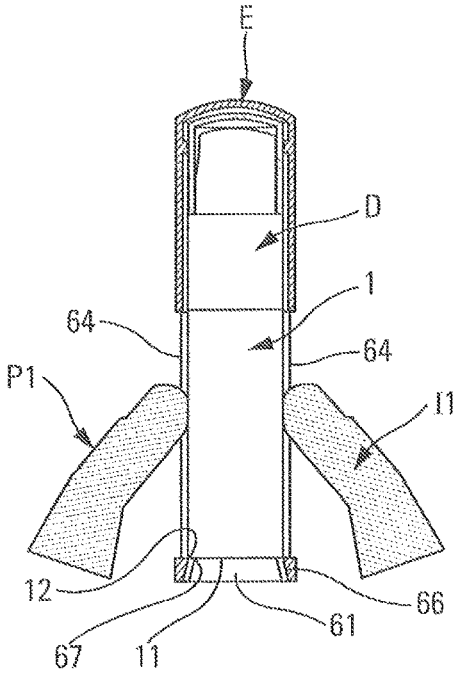
Figure 5B:
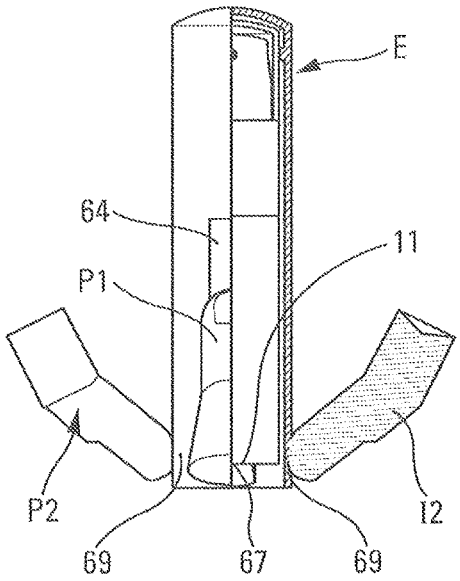
Figure 6A:
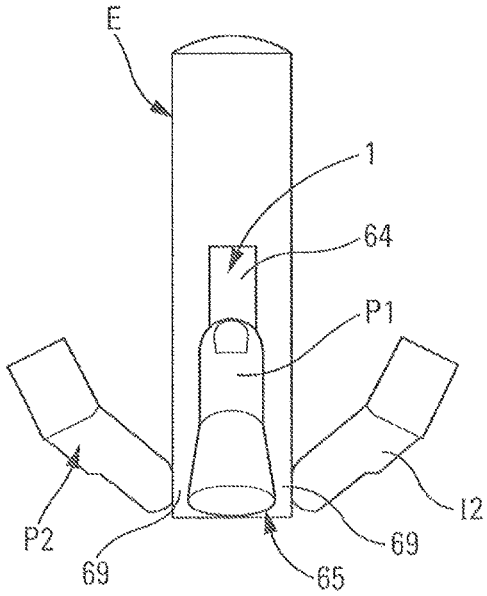
Figure 6B:
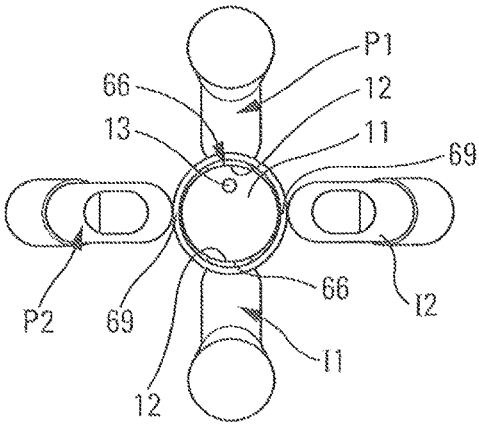
Figure 7:
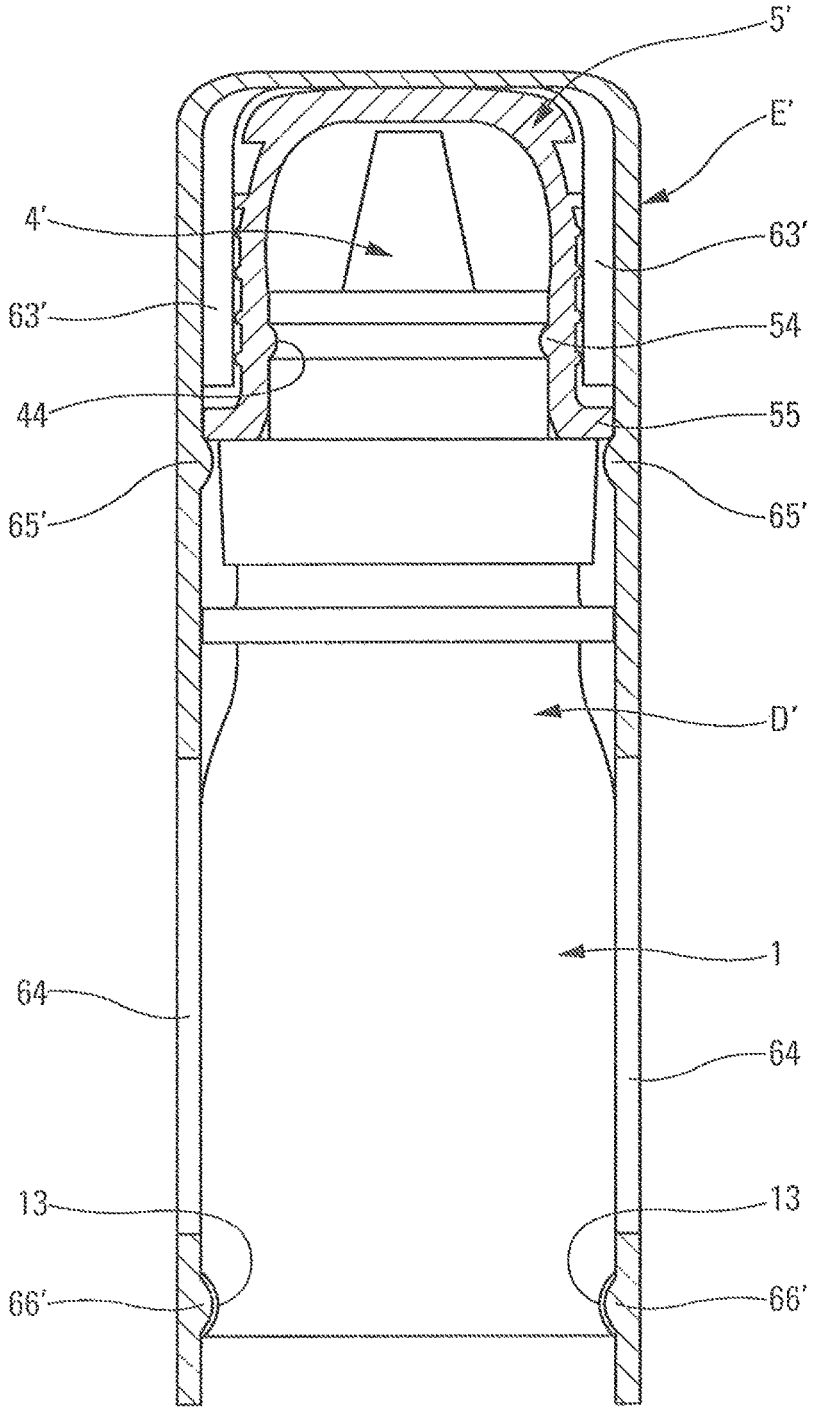

In the figures:

FIG. 1*a* is a diagrammatic elevation view of a fluid dispenser of the invention;

FIG. 1*b* is a vertical section view through a casing of the invention;

FIGS. 2*a* and 2*b* are views partially in section showing the fluid dispenser inside the casing as seen from two different angles;

FIG. 3*a* is a view similar to the view in FIG. 1*a*, after extracting the dispenser from the casing;

FIG. 3*b* is a view similar to the view in FIG. 2*a*, after extracting the dispenser from the casing;

FIG. 4*a* is a very greatly enlarged view from below of the dispenser inside the casing in the rest position;

FIG. 4*b* is a view similar to the view in FIG. 4*a* when the casing is subjected to opposite pressure forces F;

FIG. 5*a* is a view similar to FIG. 2*a* showing the positioning of digits on the reservoir of the dispenser through the slots;

FIG. 5*b* is a view similar to FIG. 2*b* showing two other digits exerting pressure on the collar of the casing;

FIG. 6*a* is a very diagrammatic perspective view showing the positioning of digits on the casing and on the reservoir of the dispenser;

FIG. 6*b* is a view from below, showing the positioning of four digits on the casing and on the dispenser; and FIG. 7 is a view partially in section showing a dispenser in a second embodiment of the invention.

With reference initially to FIGS. 1*a* to 6*b*, the dispenser assembly of the present invention comprises two essential component elements, namely a fluid dispenser D and a protective casing E. The dispenser D is for receiving in removable manner inside the casing E, as described in greater detail below.

The fluid dispenser D may be in the form of a miniature dispenser or sample that presents a configuration that is generally substantially cylindrical and circular. Naturally, any fluid dispenser may be used within the ambit of the present invention. In conventional manner, the dispenser D comprises a fluid reservoir 1, a fluid dispenser member 2 that may be a pump or a valve, a fastener ring 3 for fastening the dispenser member 2 on the reservoir 1 in leaktight manner, a pusher 4 that is mounted on the outlet of the dispenser member 2, and optionally a protective cap 5 that covers the pusher 4. The reservoir 1 defines a bottom wall 11 that is defined by an annular edge 12. At its opposite top end, the reservoir 1 defines an opening, e.g. in the form of a neck, in which the dispenser member 2 is arranged and mounted in stationary manner by means of the fastener ring 3. In conventional manner, the dispenser member comprises a body 20 that may be associated with a dip tube 21 that extends into the proximity of the bottom wall 11 of the reservoir. The dispenser member 2 also comprises an actuator rod 22 that is axially movable down and up, so as to put a fluid chamber (not shown) under pressure. The fluid that is driven through the dispenser member 2 reaches the pusher 4 that forms a dispenser orifice 41, e.g. in the form of a spray nozzle. The protective cap 5 comprises a top wall 52 and a peripheral skirt 51 that surrounds the pusher 4 and that is mounted in removable manner on a stationary element of the dispenser, such as the fastener ring 3, for example. The cap may be held on merely by friction or by weak snap-fastening. This design is entirely conventional for a dispenser, e.g. of sample type, in the fields of perfumery and even cosmetics.

The protective casing E comprises a cylinder 60 that is substantially cylindrical and that is closed at its top end by a wall 62, e.g. a dome-shaped wall. At its opposite bottom end, the cylinder 60 defines an insertion and extraction opening 61 that broadly gives access to the inside space formed by the cylinder 60. In the proximity of its top end, the inside of the cylinder 60 may form holder means 63 that, by way of example, may present an annular bead that projects inwards. It is also possible to envisage separate bead segments. At its bottom end, the cylinder 60 defines a collar 65 that is elastically deformable and that forms the insertion and extraction opening 61. The collar 65 extends below two grip slots 64 that are arranged in diametrally-opposite manner. Each grip slot 64 extends over a height that corresponds to about half the total height of the casing. The width of the slots 64 is determined to enable the dispenser to be gripped by the tips of digits. The grip slots 64 advantageously extend over the bottom portion of the casing from the collar 65, which is of limited height. Below each grip slot 64, the collar 65 defines a blocking segment 66 of shape that is arcuate, as can be seen in FIGS. 4*a* and 4*b*. Each blocking segment 66 defines a blocking top edge 67 that is sharp and that points inwards and upwards. The segments 66 also form a sloping inside face 68, so as to make it easier to insert the dispenser inside the casing through the insertion and extraction opening 61. By way of example, each blocking segment 66 may extend over the width of the grip slots 64. Between the blocking segments 66, the collar 65 presents a wall thickness that is small, which makes said collar elastically deformable. The collar 65 thus defines two unblocking sections 69 that are arranged in diametrally-opposite manner and that are offset by 90° relative to the blocking segments 66. This is clearly visible in FIGS. 4*a* and 4*b*. In these figures, it can also be seen that the bottom wall 11 of the reservoir 1 may be provided with a vent hole 13, when the reservoir 1 incorporates a follower piston. The blocking sharp edges 67 of the blocking segments 66 project radially inwards relative to the remainder of the collar in which the press sectors 69 are formed. Thus, when the dispenser D is inserted into the casing E through the insertion and extraction opening 61, the annular edge 12 of the bottom wall 11 of the reservoir 1 may come to be housed just above the blocking sharp edges 67, as can be seen in FIG. 2*a*. The dispenser D is then blocked inside the casing E. This is a storage position, while the dispenser is not being used.

When the user wishes to extract the dispenser D from the casing E, it is necessary to de-activate the blocker means. More precisely, it is necessary to release the annular edge 12 of the bottom wall 11 from its snap-fastened engagement with the blocking sharp edges 67. To do this, the user presses on the unblocking sections 69, as shown in FIG. 4*b*. As a result of being elastically deformable, the collar 65 becomes oval in shape, thereby causing the two blocking segments 66 to move apart. By exerting sufficient pressure, the blocking sharp edges 67 are moved apart until the edge 12 of the bottom wall 11 of the reservoir 1 is released. This is shown in FIG. 4*b*. At this moment, the user may grip the reservoir 1 of the dispenser D through the two opposite grip slots 64, as shown in FIG. 5*a*, while continuing to press on the unblocking sectors 69, as shown in FIG. 5*b*. By way of example, the user can use the thumb P1 and the index finger I1 of one hand to grip the reservoir of the dispenser through the grip slots 64, and can use the thumb P2 and the index finger 12 of the other hand to maintain pressure on the unblocking sections 69. It then suffices for the user to move the reservoir 1 by sliding through the grip slots 64, so as to extract the bottom wall of the reservoir from the casing. From that moment on, the user can pull on the reservoir so as to extract the dispenser D completely from the casing E.

FIGS. 6*a* and 6*b* clearly show the positioning of the user's digits, both on the press sectors 69 of the casing E, and on the reservoir 1 through the grip slots 64.

The blocker means 66 and the unblocker means 69 impose a particular combination of hand actions that a child would have difficulty performing, for example. Specifically, maintaining pressure on the collar 65 combined with gripping and sliding the reservoir 1 through the grip slots 64 are not natural or logical manipulations for a child.

In an embodiment, the dispenser D may be provided with a protective cap 5, as described above. In this configuration, when inserting the dispenser D into the casing E for the first time, the cap 5 comes into engagement with the holder means 63 of the casing E, so as to hold it permanently in that position. While extracting the dispenser D, the protective cap 5 remains held captive inside the casing E, as shown in FIG. 3*b*. The dispenser D is thus extracted without its protective cap, as shown in FIG. 3*a*. In a variant that is not shown, the dispenser D may quite simply not have a protective cap 5 and, in that configuration, the casing E acts as an incorporated protective cap.

Without going beyond the ambit of the invention, the casing may define only one grip slot, such that the dispenser is slid out from the casing by using only one digit. The grip slots could be arranged closer to the top of the casing. In addition, the blocker means could come into engagement with another component element of the dispenser, such as the fastener ring, for example. The blocker means could be more localized, and not extend continuously over a circular arc. Engagement along the reservoir could also be envisaged. The unblocker means could act by pivoting instead of becoming oval.

The invention thus provides a protective casing E that may be used as a replacement for, or in addition to, a conventional protective cap, and that for the purpose of extracting the dispenser, requires a combination of manipulations that are not intuitive for a child.

Reference is made below to FIG. 7 which shows a second embodiment of the invention that uses the same main elements, namely a casing E', and a dispenser D' with a reservoir 1, a pusher 4', and a protective cap 5'.

When inserting the dispenser D' into the casing E' for the first time, the cap 5' comes into engagement with the holder means 63' and/or 65' of the casing E', so as to hold it permanently in that position. While extracting the dispenser D', the protective cap 5' remains held captive inside the casing E, as in FIG. 3*b*. The dispenser D' thus comes out without its protective cap, as in FIG. 3*a*. The holder means 63' are formed by vertical fins or splines that come into engagement with an outside wall of the pusher 4'. The holder means 66' are formed by an annular snap-fastener bead, above which a projecting outer collar 55 of the cap comes to be housed. From the moment the cap 5' is permanently held captive in the casing E', it may be considered that it forms an integral part thereof.

According to an advantageous characteristic, the dispenser D' is held in the protective cap 5' by snap-fastening 44, 54 or by friction. More precisely, an inside wall of the cap 5' may form a projecting snap-fastener profile 54, and an outside wall of the pusher 4' may form a snap-fastener groove 44 that is suitable for receiving the snap-fastener profile 54 in removable manner, or vice versa. Alternatively or in addition, the pusher may be received with friction inside the cap. The snap-fastener profile and groove and/or the friction form the blocker means that are suitable for blocking the dispenser D' in the casing E' that incorporates the cap 5'.

According to another advantageous characteristic, the dispenser D' is held in the casing E' by snap-fastening 13, 66' that is situated along the height of the reservoir 1. More precisely, the reservoir 1 may form a snap-fastener groove 13, e.g. in the proximity of its bottom wall, and the inside wall of the casing E' may form a snap-fastener bead 66' that is suitable for receiving the bead 13 in removable manner. The snap-fastening 13, 66' may be used as a replacement for, or in addition to, the snap-fastening 44, 54 and/or the friction at the cap.

Whatever the blocker means for holding the dispenser D' in the casing E', they may be de-activated by gripping the dispenser D' through the slots 64 of the casing E', and pulling thereon so as to cause it to slide out from the casing. Thus, the grip slots 64 constitute or form unblocker means that are suitable for de-activating the blocker means.

The invention claimed is:

1. A fluid dispenser assembly comprising a fluid dispenser having a reservoir forming a bottom wall, a dispenser member and a pusher;

the dispenser assembly further comprises a casing that surrounds and covers the fluid dispenser at least in part, and that defines an insertion and extraction opening about an axis such that the fluid dispenser is insertable in the casing by sliding through the insertion and extraction opening along the axis, the casing including blocker means for blocking the fluid dispenser in the casing, and unblocker means for de-activating the blocker means so as to be able to extract the fluid dispenser from the casing by sliding;

wherein the dispenser member comprises an actuator rod and the pusher is mounted on the actuator rod, the pusher comprising a dispenser orifice through which content of the fluid dispenser is dispensed upon pressing the pusher;

wherein the casing is closed by a top wall at an end of the casing opposite the insertion and extraction opening; and wherein the casing further includes at least one grip slot through which the fluid dispenser may be gripped by means of one or two digits, so as to slide the fluid dispenser in the casing when the blocker means are de-activated.

2. A dispenser assembly according to claim 1, wherein the casing forms a protective cap for the pusher.

3. A dispenser assembly according to claim 1, wherein the casing includes holder means for holding a protective cap for the pusher inside the casing, the protective cap coming into engagement with the holder means of the casing when inserting the dispenser into the casing for the first time, so as to hold the protective cap permanently in place in the casing.

4. A dispenser assembly according to claim 1, wherein the blocker means comprise blocking edges that are sharp and configured to engage the reservoir.

5. The dispenser assembly according to claim 4, wherein the blocking edges are configured to engage the bottom wall of the reservoir.

6. A dispenser assembly according to claim 1, wherein the blocker means are formed at a collar that is elastically deformable and that forms the unblocker means.

7. A dispenser assembly according to claim 6, wherein the blocker means are arranged in diametrically-opposite manner, such that elastically deforming the collar causes the blocker means to move away from each other, so as to release the dispenser.

8. A dispenser assembly according to claim 1, wherein the at least one grip slot is arranged above an elastically-deformable collar.

9. A dispenser assembly according to claim 8, wherein the essentially deformable collar forms the blocker means that are arranged in diametrically-opposite manner below respective grip slots.

10. A dispenser assembly according to claim 8, wherein the blocker means are separated by the unblocker means in the form of unblocking sections of the essentially deformable collar, on which sections pressure is exerted to deform the collar elastically, and to move the blocker means away from each other, so as to be able to slide the fluid dispenser out from the casing by gripping the fluid dispenser through the grip slot.

11. The dispenser assembly according to claim 1, wherein the dispenser member is a pump.

12. The dispenser assembly according to claim 1, wherein the casing includes two opposite grip slots, including said at least one grip slot, through which the fluid dispenser can be gripped by one or two digits, so as to slide the dispenser in the casing when the blocker means are de-activated.

13. The dispenser assembly according to claim 1, wherein the unblocker means comprise unblocking sections of the collar on which pressure is exerted to deform the collar elastically.

14. A fluid dispenser assembly comprising a fluid dispenser having a reservoir forming a bottom wall, a dispenser member and a pusher;

the dispenser assembly further comprises a casing that surrounds the fluid dispenser at least in part, including the dispenser member and the pusher, and that defines an insertion and extraction opening about an axis such that the fluid dispenser is insertable in the casing by sliding through the insertion and extraction opening along the axis, the casing including blocker means for blocking the fluid dispenser in the casing, and unblocker means for de-activating the blocker means so as to be able to extract the fluid dispenser from the casing by sliding;

wherein the dispenser member comprises an actuator rod and the pusher is mounted on the actuator rod, the pusher comprising a dispenser orifice through which content of the fluid dispenser is dispensed upon pressing the pusher;

wherein the casing is closed by a top wall at an end of the casing opposite the insertion and extraction opening; and wherein the casing further comprises at least one grip slot through which the fluid dispenser may be gripped by means of one or two digits, so as to slide the fluid dispenser in the casing.

15. A dispenser assembly according to claim 14, wherein the blocker means is fastened to the reservoir.

16. A dispenser assembly according to claim 14, wherein the casing includes holder means for holding a protective cap inside the casing, the fluid dispenser being held in the protective cap by a snap-fastening forming the blocker means.

17. A dispenser assembly according to claim 14, wherein the casing includes holder means for holding a protective cap inside the casing, the fluid dispenser being held in the protective cap by friction forming the blocker means.

18. The dispenser assembly according to claim 14, wherein the blocker means is snap-fastened to the reservoir.

19. A fluid dispenser assembly comprising:

a fluid dispenser comprising a reservoir having a bottom wall, a dispenser member having an actuator rod, and a pusher mounted on the actuator rod, the pusher comprising a dispenser orifice through which content of the fluid dispenser is dispensed upon pressing the pusher to thereby displace the actuator rod;

a protective casing in which the fluid dispenser is removably disposed;

the protective casing is a tube comprising an insertion and extraction opening at a bottom end and about a longitudinal axis of the tube, the insertion and extraction opening configured to allow insertion and removal of the fluid dispenser from the protecting casing by sliding through the opening at the bottom end and along the longitudinal axis of the tube;

the protective casing comprising means for blocking removal of the fluid dispenser from the protective casing, and means for de-activating the means for blocking removal of the fluid dispenser from the protective casing to allow removal of the fluid dispenser from the protective casing by sliding;

wherein the protective casing is closed by a top wall at an end of the protective casing opposite the insertion and extraction opening, the top wall precluding fluid from passing therethrough and covering the pusher so as to prevent access to the pusher and actuation of the fluid dispenser when the fluid dispenser is inserted in the protective casing; and wherein the protective casing prevents access to the pusher while the fluid dispenser is disposed within the protective casing; and wherein the protective casing further includes at least one grip slot through which the fluid dispenser may be gripped by means of one or two digits, so as to slide the fluid dispenser in the protective casing when the blocker means are de-activated.

* * * * *